US009609970B2

(12) United States Patent
Piraino

(10) Patent No.: US 9,609,970 B2
(45) Date of Patent: Apr. 4, 2017

(54) COLLAPSIBLE DRYING ROD

(71) Applicant: Vincent A Piraino, Scottsdale, AZ (US)

(72) Inventor: Vincent A Piraino, Scottsdale, AZ (US)

( * ) Notice: Subject to any disclaimer, the term of this patent is extended or adjusted under 35 U.S.C. 154(b) by 0 days.

(21) Appl. No.: 14/909,721

(22) PCT Filed: Feb. 28, 2015

(86) PCT No.: PCT/US2015/018206

§ 371 (c)(1),
(2) Date: Feb. 2, 2016

(87) PCT Pub. No.: WO2016/137521

PCT Pub. Date: Sep. 1, 2016

(65) Prior Publication Data

US 2016/0249759 A1 Sep. 1, 2016

(51) Int. Cl.

| | |
|---|---|
| ***F26B 25/18*** | (2006.01) |
| ***A47G 25/40*** | (2006.01) |
| ***A47G 25/08*** | (2006.01) |
| ***A47G 25/32*** | (2006.01) |
| ***A47G 25/48*** | (2006.01) |

(52) U.S. Cl.

CPC ..... *A47G 25/4053* (2013.01); *A47G 25/08* (2013.01); *A47G 25/32* (2013.01); *A47G 25/4015* (2013.01); *A47G 25/4046* (2013.01); *A47G 25/48* (2013.01)

(58) Field of Classification Search

CPC .... F26B 3/00; F26B 5/00; F26B 11/00; F26B 19/00; F26B 25/18; A47G 25/40

USPC ..... 34/90, 240

See application file for complete search history.

(56) References Cited

U.S. PATENT DOCUMENTS

| | | | | |
|---|---|---|---|---|
| 2,618,392 A * | 11/1952 | Keutzer | A47G 25/0685 211/100 |
| 3,874,572 A | 4/1975 | McClenning | |
| 5,044,507 A * | 9/1991 | Shulyak | D06F 57/08 211/203 |
| 5,778,556 A * | 7/1998 | Ohsugi | A43D 3/1408 211/34 |

(Continued)

FOREIGN PATENT DOCUMENTS

| | | |
|---|---|---|
| CN | 2018474818 U | 6/2011 |
| CN | 201987226 U | 9/2011 |

(Continued)

*Primary Examiner* — Stephen M Gravini
(74) *Attorney, Agent, or Firm* — Invention To Patent Services; Alex Hobson

(57) ABSTRACT

A collapsible drying rod has an elongated support potion that is collapsible into at least three portions that can be disengaged, or pulled apart, and aligned with each other to provide a compact collapsed drying rod that is held together by an elastic tether. A collapsible drying rod may have a center support member and extensions that extend out from opposing ends of the center support member. An elastic tether may be configured within a conduit that extends along the length of the center support member and/or extensions. A collapsible drying rod may include a hanger portion that is attached to the center support member by a hanger retainer having a flexible extension that can be used to retain the collapsible drying rod to a support.

20 Claims, 16 Drawing Sheets

(56) References Cited

U.S. PATENT DOCUMENTS

| | | | | | |
|---|---|---|---|---|---|
| 5,845,414 | A * | 12/1998 | Ohsugi | D06F 57/12 | 211/197 |
| 6,454,145 | B1 * | 9/2002 | Russ | A47G 25/20 | 223/85 |
| 7,040,517 | B1 * | 5/2006 | Swanson | A47G 25/10 | 223/85 |
| 7,770,305 | B1 * | 8/2010 | Krauss | D06F 57/12 | 211/104 |
| 8,381,413 | B2 * | 2/2013 | Smith | F26B 25/18 | 211/116 |
| 8,459,514 | B2 | 6/2013 | Lagzdins | | |
| 9,359,710 | B2 * | 6/2016 | Lee | D06F 58/10 | |
| 2016/0249759 | A1 * | 9/2016 | Piraino | A47G 25/4053 | |

FOREIGN PATENT DOCUMENTS

| | | | | | |
|---|---|---|---|---|---|
| EP | 0 479 729 | * | 9/1991 | | |
| FR | 2480809 | A1 * | 10/1981 | D06F 57/00 | |
| GB | 701818 | A * | 1/1954 | D06F 58/14 | |
| JP | 10244098 | A * | 9/1998 | | |
| WO | 00-15087 | A1 | 3/2000 | | |
| WO | WO 2016137521 | A1 * | 9/2016 | A47G 25/4053 | |

* cited by examiner

COLLAPSIBLE DRYING ROD

BACKGROUND OF THE INVENTION

Field of the Invention

The invention is directed to collapsible drying rods.

Background

When backpacking or camping, it is important to keep clothes, tents, towels and other articles dry. Wet articles are heavy and are not good thermal insulators. Many backpackers drape theirs clothes and tents over tree limbs or lay them flat on the ground to increase the rate of drying. This practice can soil and potentially damage the articles or result in them being blow away. Finding a tree limb that is appropriate to drape articles over is difficult depending on the location and articles can become soiled from tree debris. In some cases, sharp projections on the tree limb can result in punctures of the articles draped thereover. In addition, in the event of strong winds, articles draped over a tree or laid on the ground can be blown away.

Travelers are becoming increasing more physically active. Many travelers make a point to visit the hotel gym, go for run, or workout in their room while traveling to stay in shape and get some much needed exercise. These travelers do not have time in many cases to launder their workout clothes and yet they do not want to place them in their suitcase because of their odor. Some travelers wash out their workout clothes in the sink and ring them out as best as possible. In addition, garments including workout apparel and undergarments made with quick drying fabric enable travelers to bring fewer garments as these types of garments can effectively be hand-washed and air-dried overnight. In order for these garments to be effectively dried overnight however, they need air circulation. Suspending or hanging these garments can provide an effective amount of air circulation.

Urban backpacking is also becoming more popular. Urban backpackers may travel from one city to the next and often times travel very light, carrying a minimal number of garments and provisions. Urban backpackers may therefore find it desirable to have garments that can be washed out by hand and dried quickly.

There exists a need for a means to dry articles, including clothes and backpacking gear that is compact and lightweight.

SUMMARY OF THE INVENTION

The invention is directed to a collapsible drying rod that has extensions that are coupled to a center support potion by an elastic tether. In an exemplary embodiment, a collapsible drying rod comprises an elongated support potion that is collapsible and has at least three portions that can be disengaged or pulled apart and aligned with each other to provide a compact collapsed drying rod. An exemplary collapsible drying rod has a center support member and any suitable number of extensions including, but not limited to, two, three, four, five, six and the like. Each extension may be disengaged from the other extensions, or the center support portion, but coupled by an elastic tether. An elastic tether may be configured within a conduit that extends along the length of the center support member and/or extension. An exemplary collapsible drying rod comprises a hanger portion that is attached to the center support member by a hanger retainer and comprises a flexible extension that can be used to retain the collapsible drying rod to a support. The flexible extension can be wrapped around a support, such as a limb of a tree, and attached to the hanger retainer to securely fasten the collapsible drying rod to a support. The collapsible drying rod will not detach from the support in the event of high winds, as the flexible extension extends around the support.

In an exemplary embodiment, an elongated support has a length from a first terminal end to a second terminal end of about, 25 cm or more, about 35 cm or more, about 50 cm or more, about 70 cm or more, about 100 cm or more and any range between and including the length values provided. In an exemplary embodiment, an elongated support comprises tubes having an inner diameter and an outer diameter. The tubes may have any suitable outer dimension, or diameter, such as about 5 mm or more, 10 mm or more, about 15 mm or more, about 25.4 mm or more, about 35 mm or more and any range between and including the outer dimensions provided, i.e. diameter. Although tubular support members are preferred, any suitable elongated support cross-sectional shape may be used including square, rectangular, oval, circular, irregular, shaped and the like. An elongated support may be made out of any suitable material including, but not limited to, plastic, metal, composites such as carbon fiber composites and the like. In a preferred embodiment, the elongated support comprises a lightweight metal or composite tube that provides sufficient support, with a relatively small outer diameter, thereby making it compact.

The first and second extensions comprise an engagement end and an extended end. The engagement end is configured for engagement to the center support member and the extended end extends away from the center support member. The engagement end of an extension may be truncated or have a reduced size to enable the engagement end to be inserted into the center support potion. For example, the outer diameter of a truncated end may be smaller in dimension that the inner diameter of the center support member conduit, whereby the truncated end can be inserted into the conduit of the center support member to engage the extension with the center support member. In an alternative embodiment, the first and second ends of the center support member may be truncated ends and configured to fit within a conduit of the engagement ends of the first and second extensions. It is to be understood that a similar engagement geometry may be used for additional extensions, wherein a third, and fourth extension comprise a truncated end that is configured to fit within conduits of the extended ends of the first and second extensions, respectively. Again, this geometry could be reversed with the first and second extended ends having truncated ends for insertion into conduits of the third and fourth extensions, respectively.

In an exemplary embodiment, the outer dimension, or diameter, of the center support member and any extensions are substantially the same, whereby when the extensions are engaged, the outer surface of the elongated support is substantially smooth and has no substantial change in dimension from the center support member and the first and second extensions. Likewise, any subsequent extensions may be configured with the same outer dimension thereby producing an elongated support that is substantially uniform in outer dimension along the length. This is an important feature, as a smooth and continuous surface will allow clothes and other articles draped thereon to slide along the length of the collapsible drying rod without snagging and becoming damaged.

The extensions are held in place by an elastic tether that is in a strained state even when the extensions are engaged with each other or the center support member, as described herein. The elastic tether not only holds the extension in an engaged configuration with the center support member or other extension, but also couples the extensions and center support member together when they are disengaged from each other. The elastic tether, thereby ensures that components are not separated from each other and lost. In addition, the tether couples the components of the elongated support together in the correct arrangement. This unique elongated support configuration enables very quick engagement of the components and assembly of the elongated support without fumbling for the correct end or part for engagement with other components, for example.

An exemplary elastic tether may comprise rubber or elastic, and may be a shock cord or a bungee cord, for example. An elastic tether may be generally rod shaped, having a circular cross-section along the length, or any other suitable shape, including a strap having a square or rectangular cross-sectional shape. An elastic tether may be affixed to the center support member and extend along a conduit into one or more extensions and provide tension that pulls and holds the extensions into engagement with the center support member. To disengage an extension form the center support member, the extension must be pulled with enough force to overcome the tension of the tether. In another embodiment, an elastic tether extends completely through the center portion and is affixed to opposing extensions, or extensions configured on either end of the center support member. A tether may extend to the furthest most displaced extension, or an end extension that is the extension most displaced from the center support member when the elongated support member is assembled, and be affixed thereto. In other exemplary embodiment, an elastic tether extends through an extension and is affixed to an end portion. An end portion may be attached to an end extension, whereby the end extension is pulled toward the center support member by the tension in the tether.

A press-ball may be incorporated into one the extension or on a center support member. A press-ball may be configured on the outer surface of a truncated end and extend up into a corresponding aperture in an extension or center support component. In this way, a user may have to press the press-ball down to disengage the extension from the center support member or other extension. In another embodiment, a protrusion may be configured on a truncated end that is configured to slide along a slot on the mating end of the extension or center support component. The slot may have a protrusion retainer that is configured to hold the protrusion in place. A user may align the protrusion with the slot and slide the extension into the conduit and then twist the extension with respect to the other component to configure the protrusion in the protrusion retainer.

The terminal ends of the elongated support may comprise an end portion such as an end cap or cover. The end portion may have a geometry to reduce the stress or load on a garment at the terminal ends of the drying rod. An exemplary end portion may have a sloped top, surface and/or a rounded end.

An exemplary hanger portion is attached to the center support member by a hanger retainer and comprises a flexible extension for securing the collapsible drying rod to a support. A hanger retainer may be detachably attached to the center support member and may comprise a button or a hook-and-loop fastener for detachable attaching to the center support member. A hanger retainer may comprise a loop of material, a ring or clip that can be used to secure a distal clip thereto. In an exemplary embodiment, a flexible extension has a distal clip, or clip on the extended end that may be clipped to the hanger retainer. In another exemplary embodiment, a flexible extension is detachably attachable to the hanger retainer and comprises a proximal clip, or clip that is on the attached end of the flexible extension. A flexible extension may be a strap or other supple material to enable easy manipulation and attachment to a wide range of supports. In addition, a flexible extension may be wrapped around a collapsed drying rod is a collapsed configuration, having all extensions disengaged from the center support member and substantially aligned in parallel with the center support member, to secure the extension and the center support member together.

A collapsible drying rod may comprise one or more hanger clips that are coupled to the elongated support for suspending article therefrom. A hanger clip, may be attached to a ring that can be slid along the length of the elongated member to allow hanging articles of various sizes.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and, constitute a part of his specification, illustrate embodiments of the invention, and together with the description serve to explain the principles of the invention.

DETAILED DESCRIPTION OF THE ILLUSTRATED EMBODIMENTS

Figure 1:
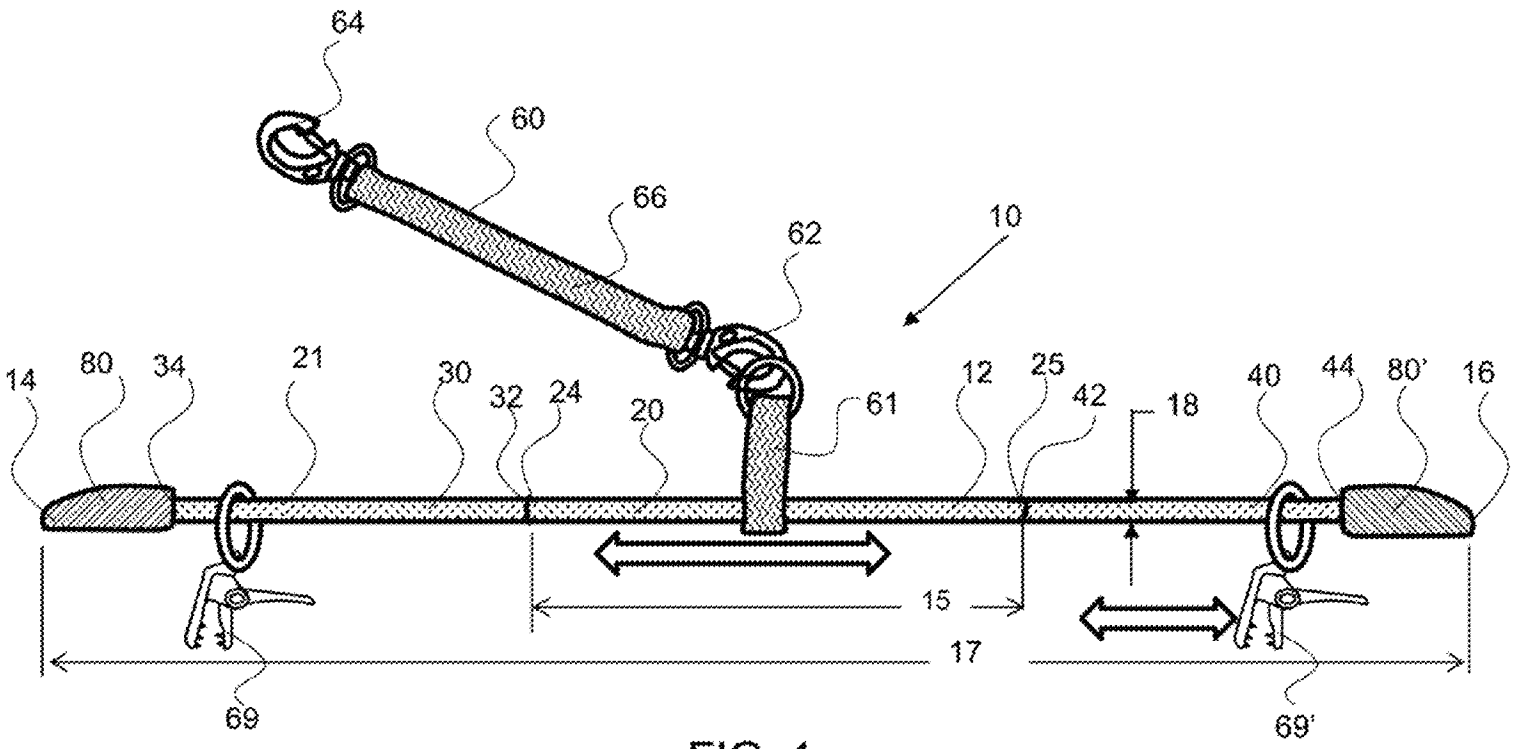

FIG. 1 shows a side view of an exemplary collapsible drying rod, as described herein.

Figure 2:
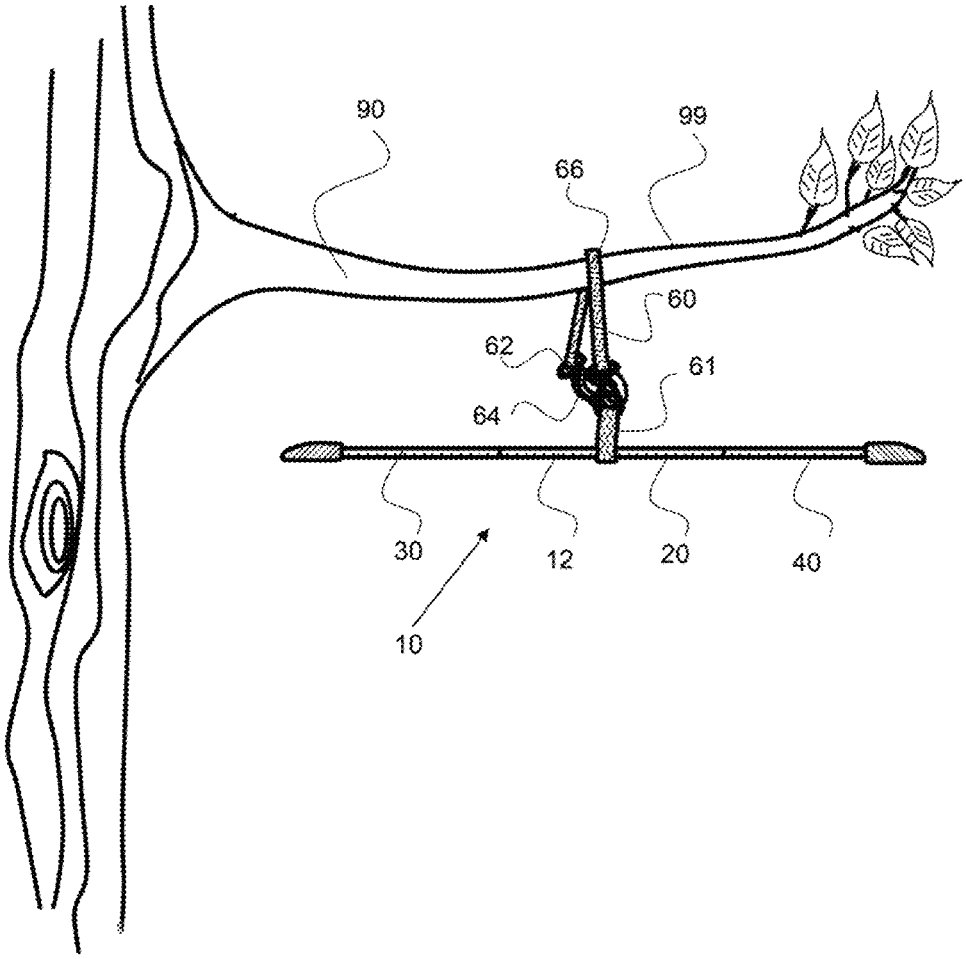

FIG. 2 shows a side view of an exemplary collapsible drying rod attached to the limb of a tree.

Figure 3A:
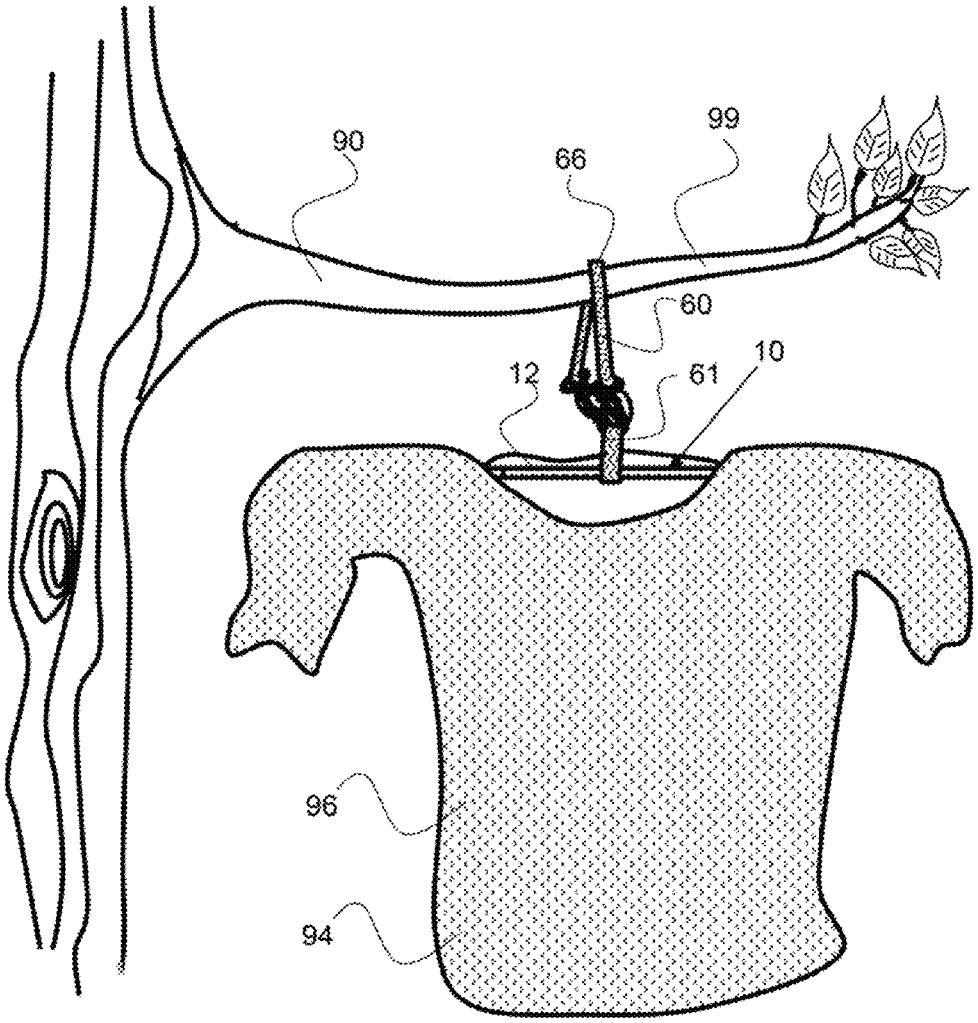
Figure 3B:
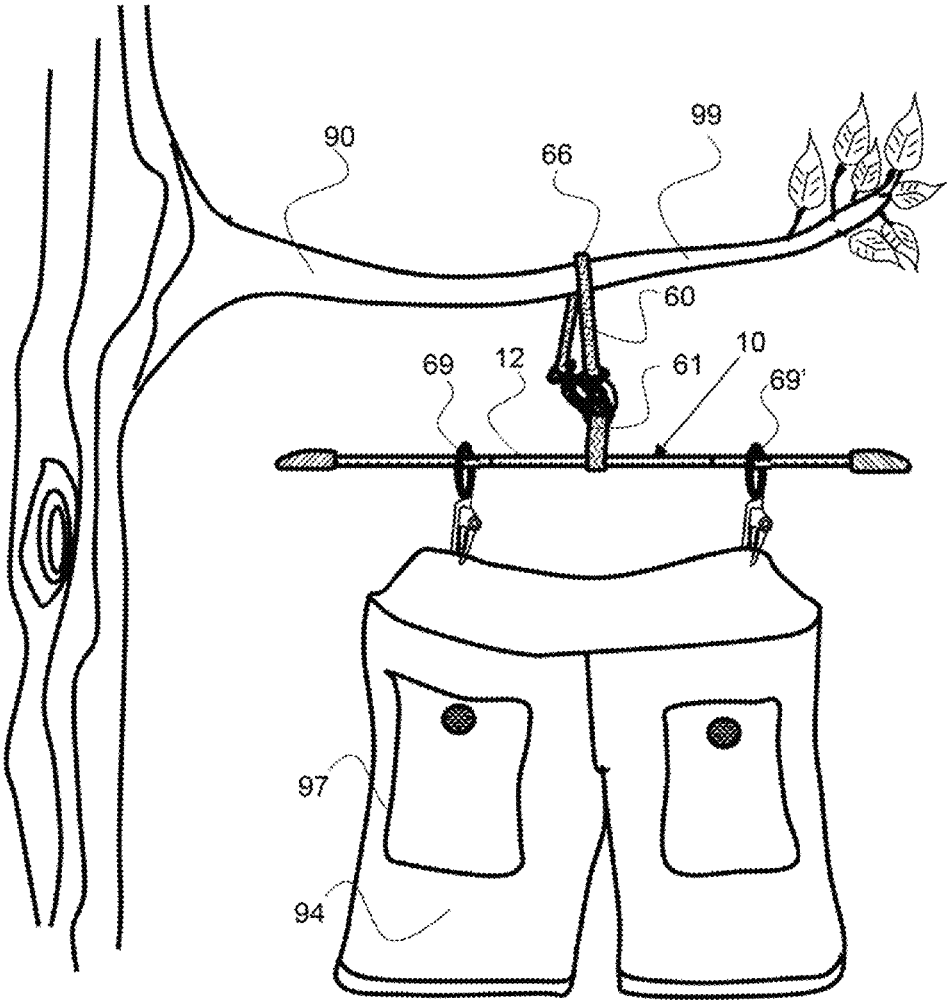
Figure 3C:
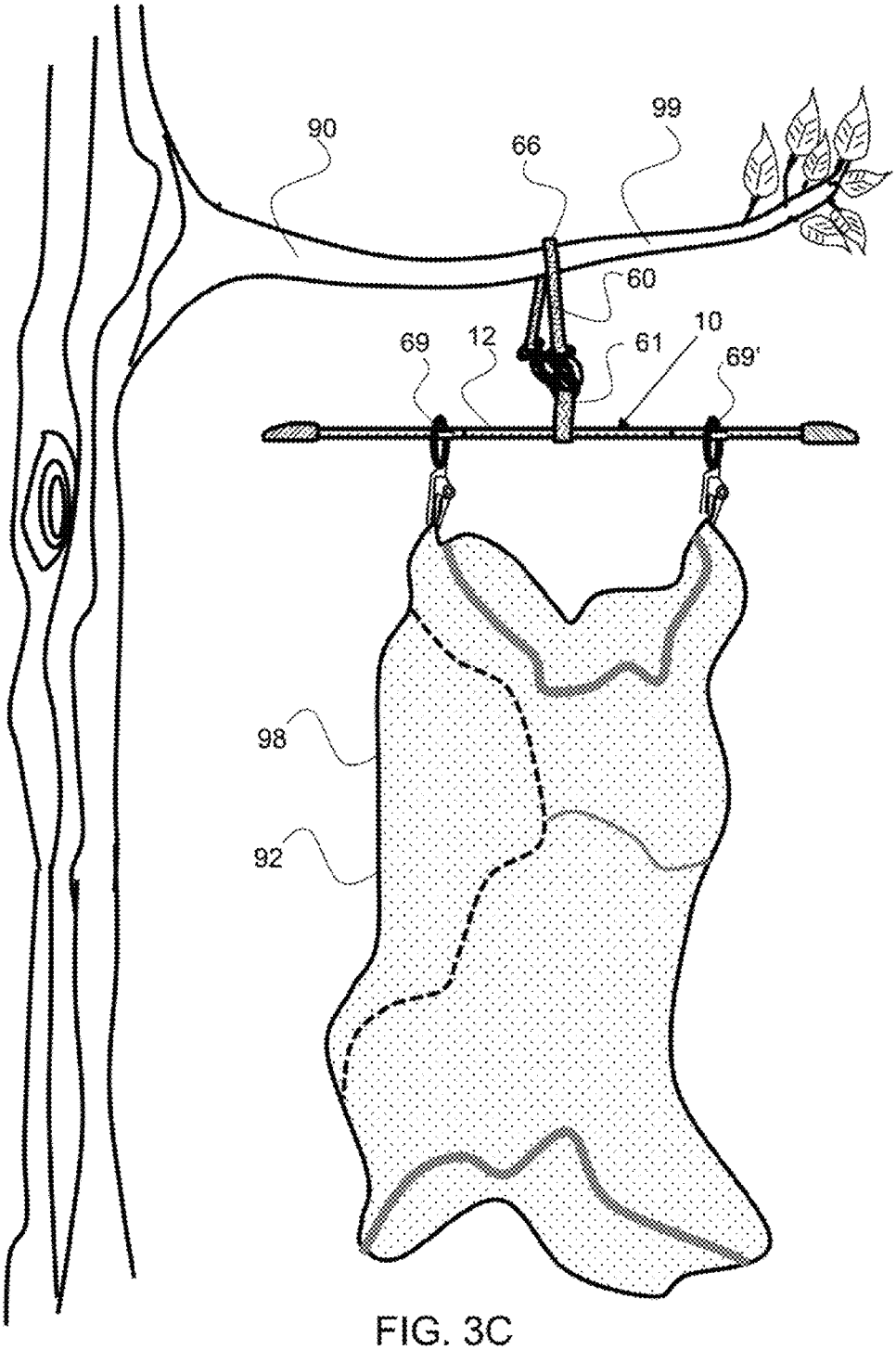

FIGS. 3A-3C show exemplary collapsible drying rods having articles hung and/or clipped thereto.

Figure 4:
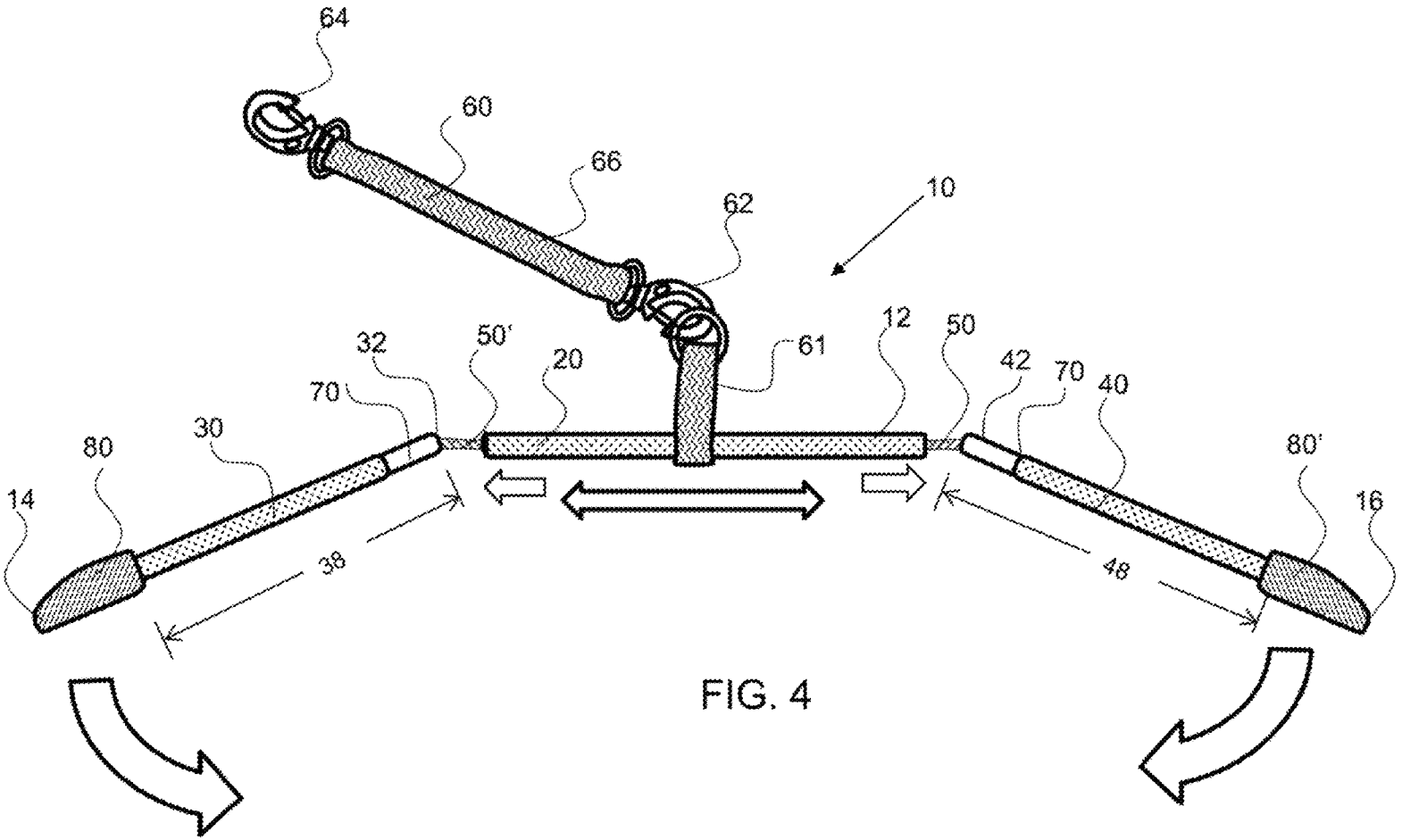

FIG. 4 shows a side view of an exemplary collapsible drying rod having a first and a second extension disengaged from the center support member but coupled to the center support member by an elastic tether.

Figure 5A:
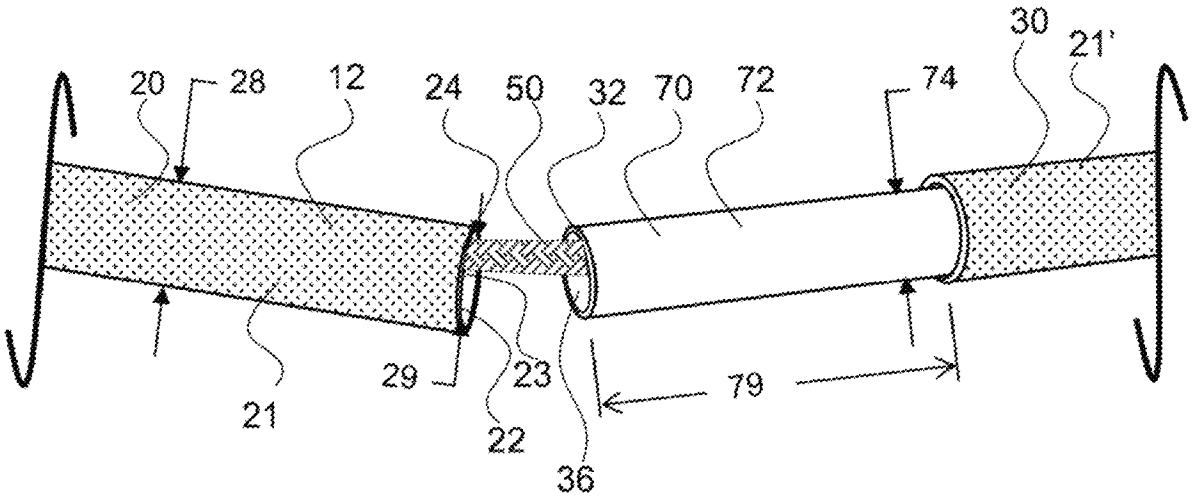

FIG. 5A shows a perspective view of an exemplary center support member and an exemplary first extension having a truncated end for insertion into the center support member, or engagement with the center support member, and a tether extending between and coupling the first extension to the center support member.

Figure 5B:
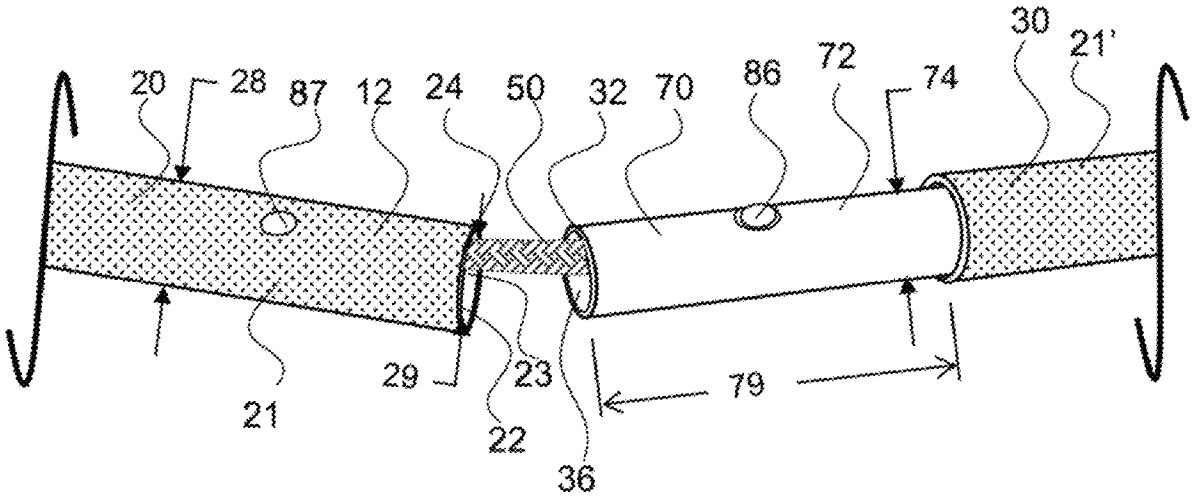

FIG. 5B shows a perspective view of an exemplary center support member and an exemplary first extension having a truncated end for insertion into the center support member and a press-ball configured on the truncated end for alignment with and extension into the corresponding aperture.

Figure 5C:
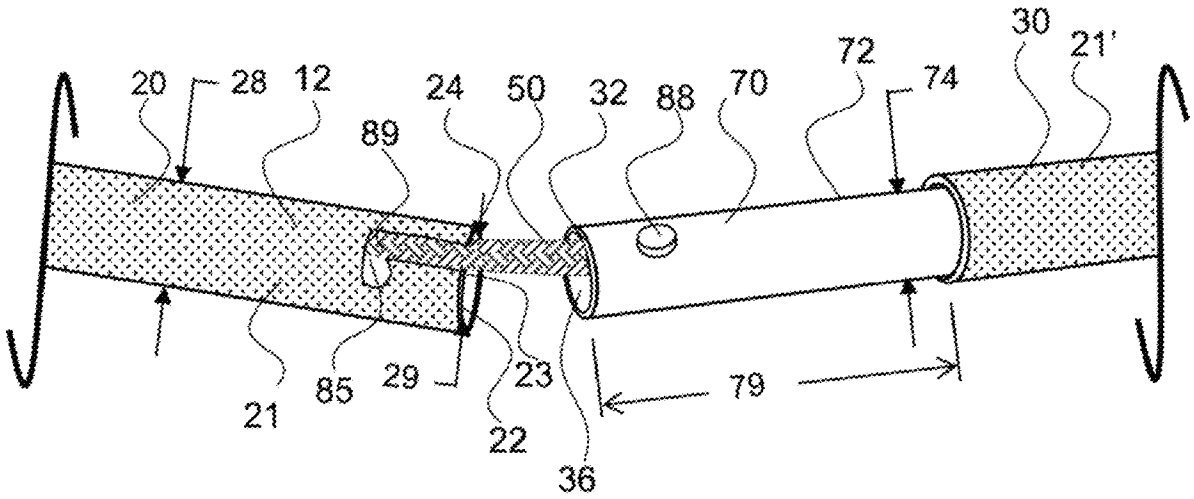

FIG. 5C shows a perspective view of an exemplary center support member and an exemplary first extension having a truncated end for insertion into the center support member and a protrusion configured on the truncated end for alignment with protrusion slot.

Figure 6:
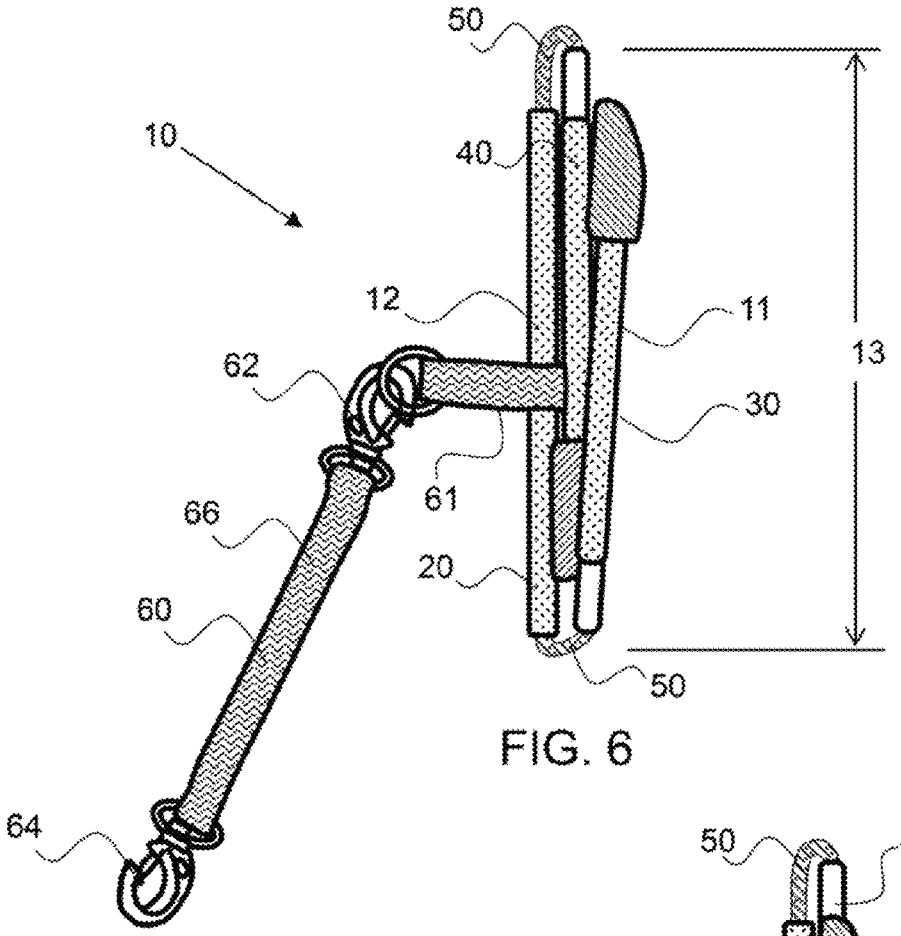

FIG. 6 shows a side view of an exemplary collapsible drying rod having both the first and second extensions configured substantially in line with, or parallel the length axis of the center support member and coupled to the center support member by a tether to form a collapsed hanger.

Figure 7:
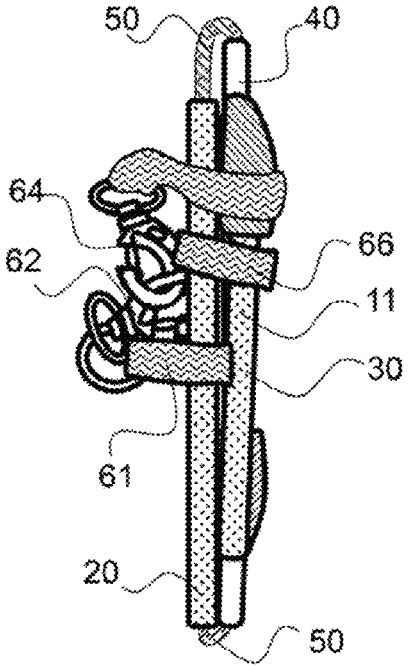

FIG. 7 shows the collapsed hanger of FIG. 6 restrained by the hanger portion having a flexible extension wrapped around the collapsed hanger.

Figure 8:
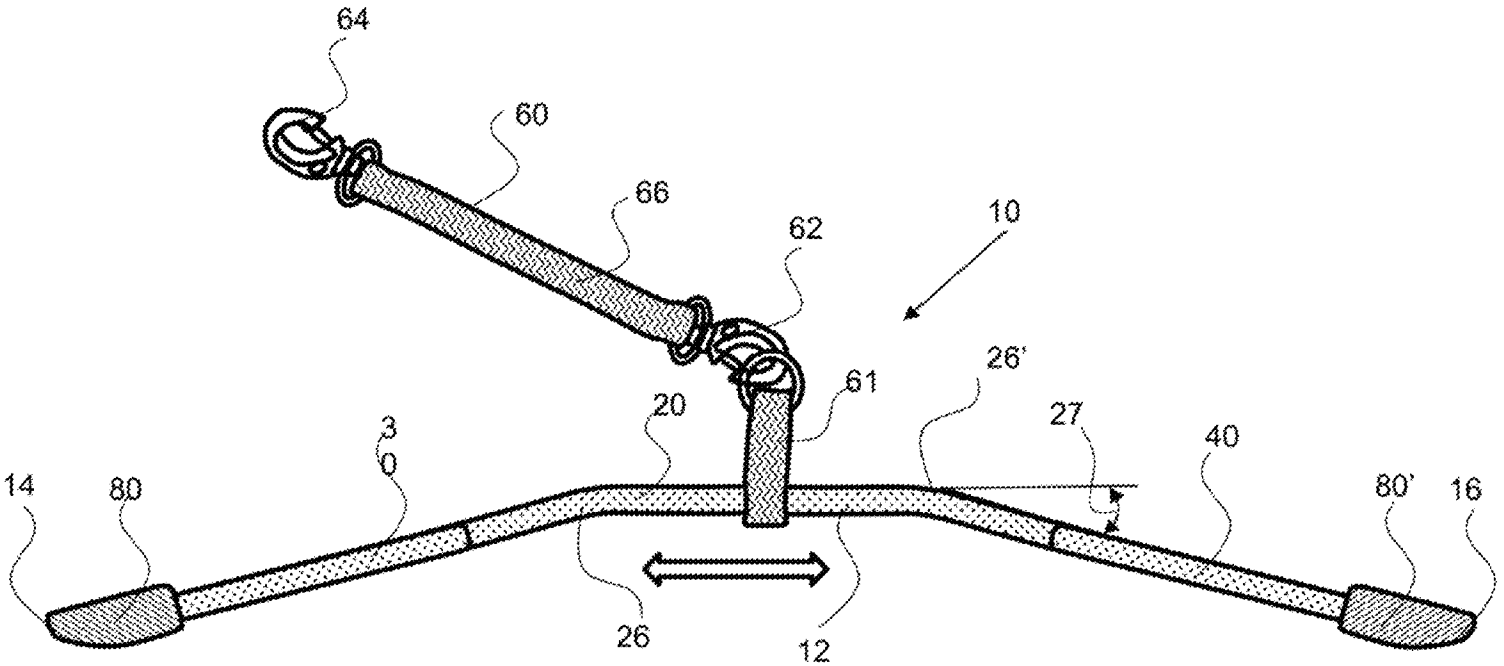

FIG. 8 shows a side view of an exemplary collapsible drying rod having a center support member having bends on either side of the hanger portion.

Figure 9:
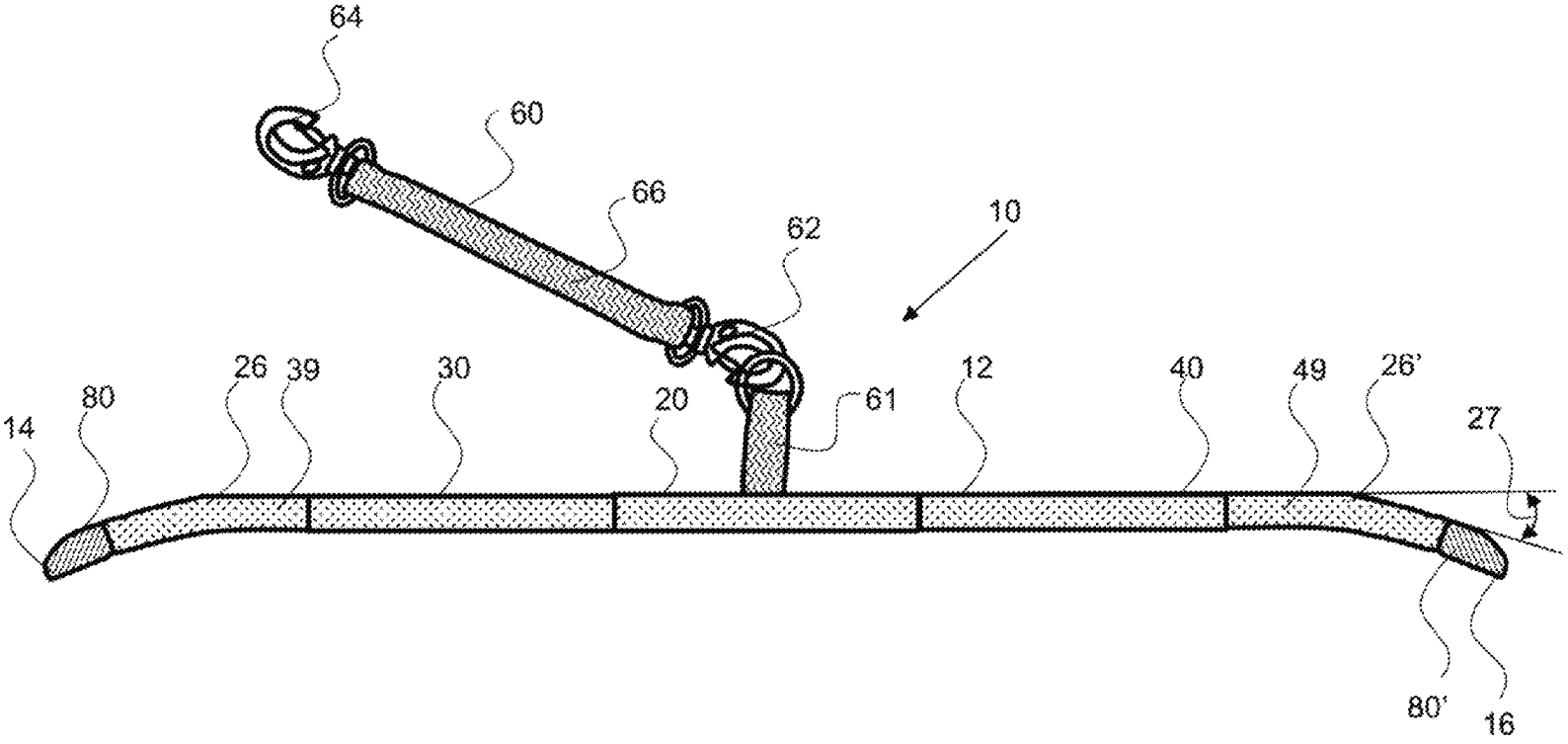

FIG. 9 shows a side view of an exemplary collapsible drying rod having first, second, third and fourth extensions and bends in the third and fourth extensions.

Figure 10:
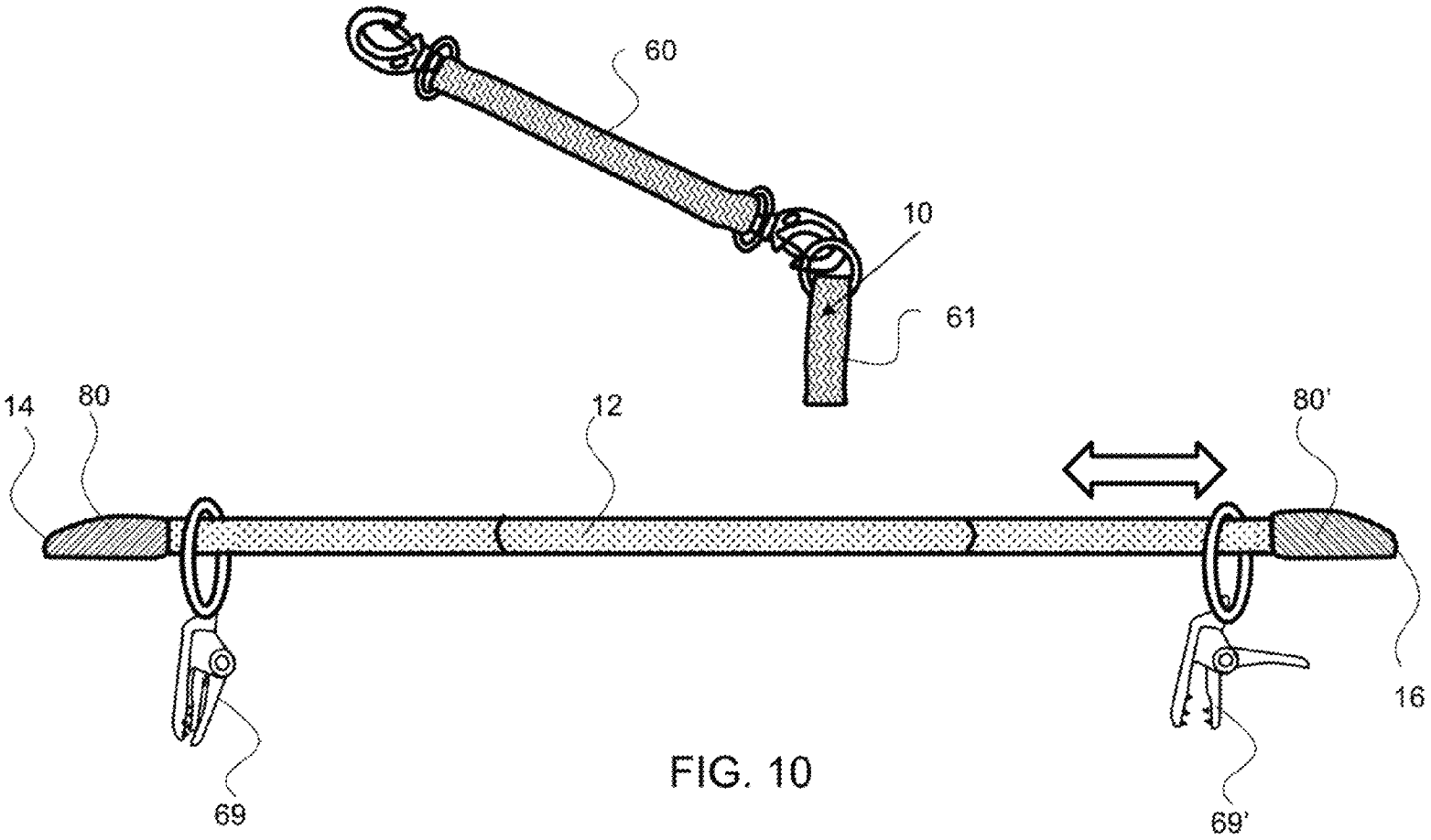

FIG. 10 shows a side view of an exemplary collapsible drying rod having a hanger portion detached from the center support member and clips attached to the elongated support.

Figure 11:
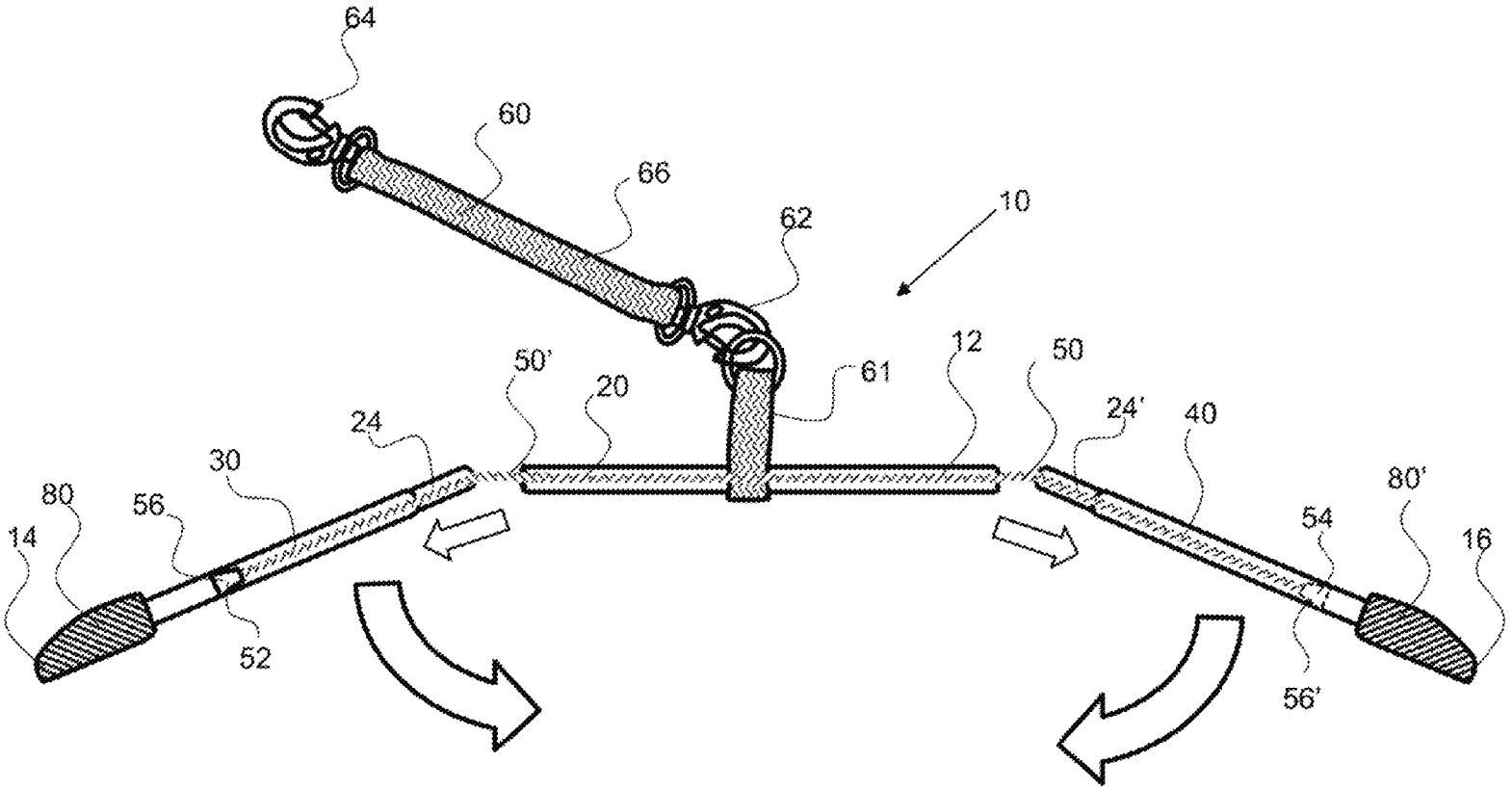

FIG. 11 shows a side view of an exemplary collapsible drying rod having first and second extensions disengaged, or pulled away, from the center support member and coupled to the center support member by an elastic tether that is retained within the first and second extensions.

Figure 12:
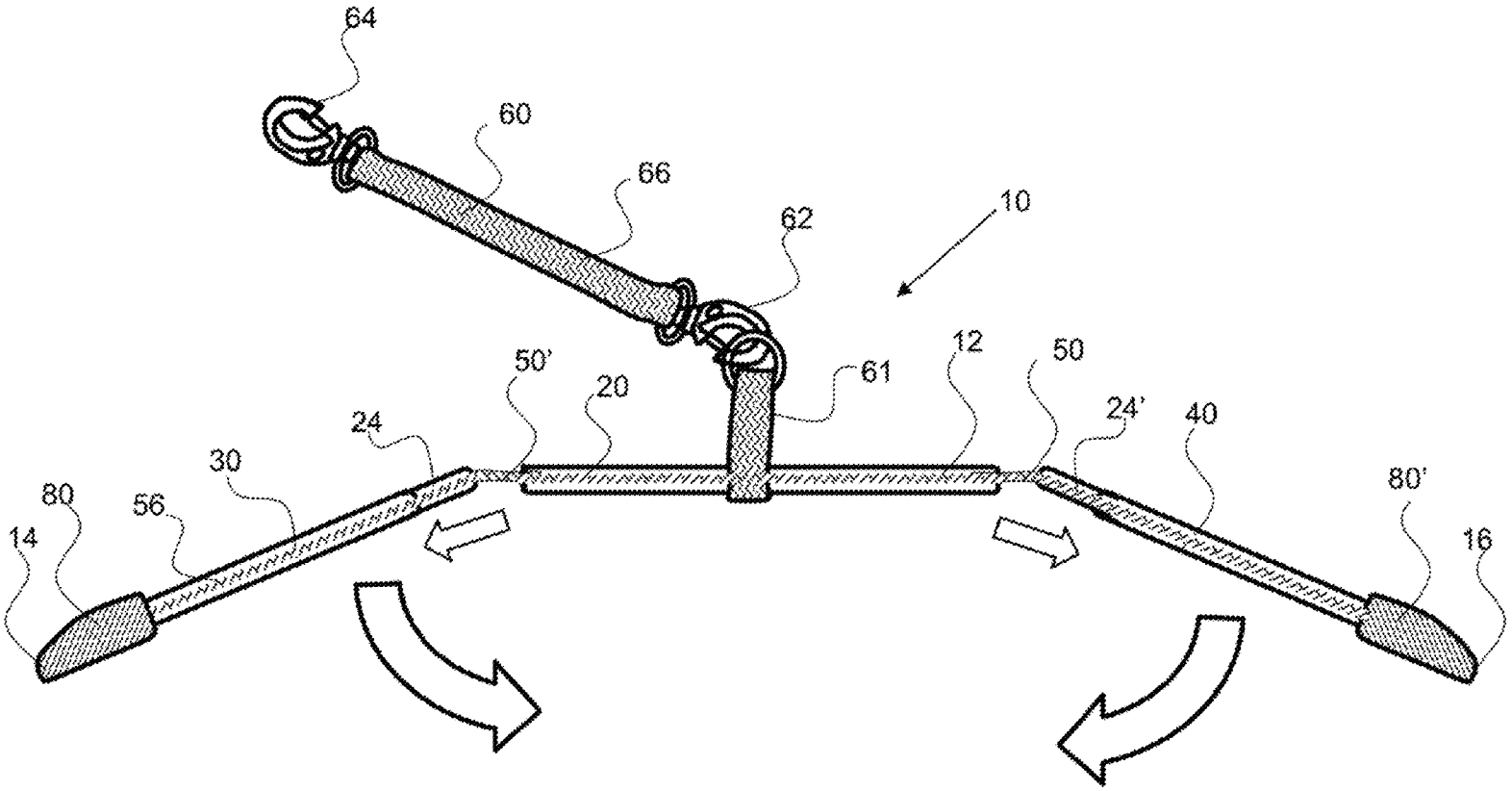

FIG. 12 shows a side view of an exemplary collapsible drying rod having a first and second extension pulled out from the center support member and coupled to the center support member by an elastic tether that is retained within the end portions.

Figure 13:
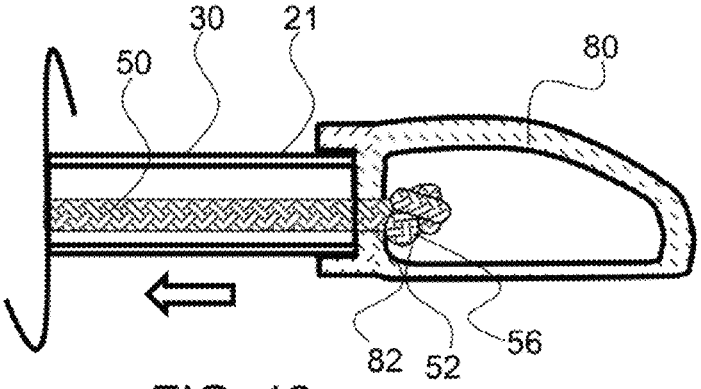

FIG. 13 shows a side view of an exemplary end portion that extends over the outer surface of the first extension and has an aperture through which the elastic tether extends.

Figure 14:
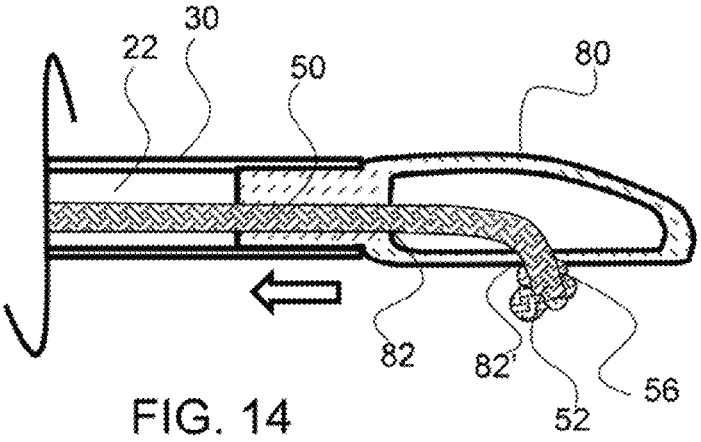

FIG. 14 shows a side view of an exemplary end portion that extends into the conduit of the first extension and has a plurality of apertures through which the elastic tether extends.

Figure 15:
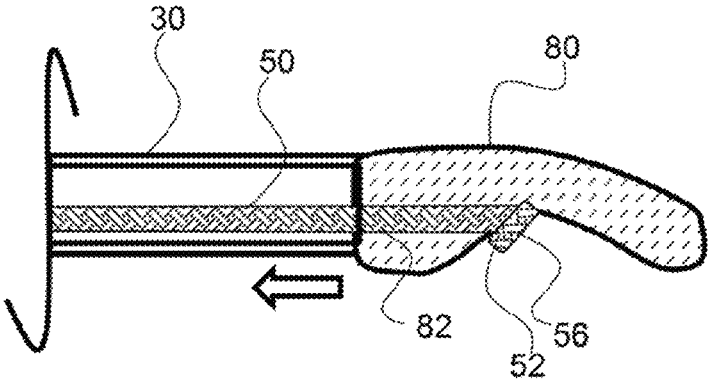

FIG. 15 shows a side view of an exemplary end portion that has an aperture through which the elastic tether extends.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary collapsible drying rod 10 comprises an elongated support 12 having a length 17. The length of the elongated support from the first terminal end 14 to the second terminal end 16 is at least ten times the cross length dimension 16 of the elongated support. The elongated support has a length axis that extends along the length as shown by the double arrow line. The elongated support in this embodiment is straight along the length axis. The elongated support comprises a center support member 20, a first extension 30 and a second extension 40. The length of the center support member 15 is shown. The outside surface 21 of the elongated support is substantially uniform along the length, wherein the outer dimension, or diameter of the center support member and first and second extensions are substantially the same. The end portions 80, 80' are attached to the first extended end 34 and second extended end 44, respectively. The first and second extensions are coupled to the center support member by an elastic tether (not shown). The first engagement end 32 of the first extension is engaged with the first end 24 of the center support member. The second engagement end 42 of the second extension is engaged with the second end 25 of the center support potion. A hanger portion 60 is detachably attached to the elongated support 12 by a hanger retainer 61. The hanger portion comprises a flexible extension 66, such as a strap, as shown, a proximal clip 62 and a distal clip 64. The flexible extension is configured to be wrapped around a support with the distal clip attached to the proximal clip, a ring extending from the hanger retainer, or the hanger retainer. The hanger retainer 61 may comprise a flexible material, such as a strap, as shown, that is coupled to the center portion of the elongated support. In addition, the exemplary collapsible drying rod 10 has hanger clips 69, 69' attached to the elongated support 12. The clips are coupled to the elongated support by rings that enable the clips to freely slide along the length of the elongated support, as indicated by the double arrow line next to clip hanger 69'.

As shown in FIG. 2, an exemplary collapsible drying rod 10 is attached to a support 90, a limb of a tree 99. The flexible extension 66 is wrapped over the limb and attached at either end to the hanger retainer 61.

Referring now to FIGS. 3A-3C, a shirt 96 is hung over the exemplary collapsible drying rod 10 as shown in FIG. 3A. The elongated support portion 12 is inserted into the neck hole of the shirt to support and hang the shirt. The collapsible drying rod is a hanger for suspending the shirt. The collapsible drying rod will not be dislodged from the limb due to wind blowing as the flexible extension 66 of the hanger portion 60 is wrapped around the limb 99. As shown in FIG. 38, a pair of shorts 97 is suspended from the collapsible drying rod 10 by the two hanger clips 69, 69'. The clips have been slid in toward the center of the elongated support 12 to effectively support the shorts. Any type of garment 94, as shown in FIGS. 3A and 3B can be suspended or hung from the collapsible drying rod. As shown in FIG. 3C, a tent 92 is being hung from an exemplary collapsible drying rod 10 by hanger clips 69, 69'. It is desirable to dry tents and other camping/backpacking gear to reduce weight and to prevent damage and/or mold forming on the articles. Any suitable article 98 could be attached to the collapsible drying rod as desired.

As shown in FIG. 4, an exemplary collapsible drying rod 10 has a first extension 30 and second extension 40 pulled out from the center support member 20, or disengaged, and coupled to the center support member by an elastic tether 50. The elastic tether 50 allows the disengaged first and second extensions to be freely moved to collapse the hanger. As indicated by the arrows, the extensions are first pulled away from the center support member along the length axis, and then can be rotated to collapse the drying rod. The first and second extensions have a length 38, 48, respectively, that extends from the engagement end to the end portion. The tether 50 extends into a conduit in the engagement end 32, 42 of each of the extensions.

As shown in FIG. 5A, an exemplary first extension 30 is pulled away from an exemplary center support member 20, whereby the first end 24 of the center support is disengaged from the first engagement end 32 of the first extension 30. The first extension has a truncated end 70 for insertion into the center support member conduit 22. The outside dimension 74, or diameter in this embodiment, of the truncated end 70 is smaller than the inside dimension 29 of the center support member conduit 22. The outside surface of the truncated end 72 will slide along the inside surface 23 of the conduit 22. The truncated end 70 has a length 79 that is configured to extend into the center support member conduit 22, thereby engaging the end of the first extension to the center support member in a secure manner. The outside surface of the center support potion 21 and the first extension 21' have the same outside dimension 28 and therefore when the truncated end of the first extension is inserted into the center support member, there is substantially no step, or change in outer dimension along the length of the elongated support in the transition between the center support member and the first extension. An elastic tether 50 extends along the conduit 22 of the center support member 20 and the conduit 36 of the first extension 36 and couples the two components of the elongated support 12 together.

As shown in FIG. 5B, an exemplary first extension 30 has a truncated end 70 for insertion into the center support member 20. A press-ball 86 is configured on the truncated end for alignment with, and extension into, the corresponding aperture 87 in the center support member 20. The press-ball is configured to extend up slightly from the outer surface 21 of the center support member when the first extension is engaged with the center support. A user may press down on the press-ball and pull on the first extension to release, or disengage, the first extension from the center support member.

As shown in FIG. 5C, an exemplary first extension 30 has a truncated end 70 for insertion into the center support member 20. A protrusion 88 is configured on the truncated end for alignment with protrusion slot 89. The protrusion slot comprises a protrusion retainer 95 configured to prevent the protrusion from freely moving along the length axis of the elongated support 12. The protrusion retainer is offset dimensionally from the length of the protrusion slot. A user may align the protrusion with the protrusion slot and slide the protrusion into the protrusion slot and then twist the extension with respect to the center support member to position the protrusion in the protrusion retainer.

As shown in FIG. 6, an exemplary collapsible drying rod 12 has both the first and second extensions 30, 40 respectively, disengaged from and configured substantially in line with, or parallel with, the center support member 20. The first and second extensions are coupled to the center support member by a tether 50 to form a collapsed drying rod 11 that is retained or held together by the tether in the correct arrangement. As described, this facilitates quick assembly of the elongated support and ensures that components are not separated from each other and lost. The elastic tether keeps the components of the elongated support coupled together but allows for free movement of the extensions. The collapsed drying rod has a collapsed length 13 that is about one third the elongated support length 17, shown in FIG. 1. A collapsible drying rod may be configured to have a collapsed length that is about one-half or less, one-third or less, one fourth or less, or one sixth, or less that of the length of the elongated support length when the extensions are engaged, as shown in FIG. 1.)

As shown in FIG. 7, the collapsed drying rod 11 of FIG. 6 is restrained by the hanger portion 60 having a flexible extension 66 wrapped around the collapsed drying rod. This collapsed and retrained configuration enables compact storage of the collapsed hanger 11. The collapsed drying rod length may be, any fraction of the engaged elongated support member and will depend on the maximum length of any one elongated support extension component including the center support and any extensions therefrom. In one embodiment, an, elongated support is comprised of five components including a center support and four, extensions, as generally shown in FIG. 9. In this embodiment, the collapsed drying rod may have a collapsed drying, rod length that is about one fifth that of the elongated support length.

As shown in FIG. 8, an exemplary collapsible drying rod 10 has a center support member 20 having bends 26, 26' on either side of the hanger portion 60. The bends produce an extended portion of the elongated support that are at an angle 27 to the length axis of the center support member, as indicated by the double arrow. The angle is an acute angle. Any suitable number of bends may be configured in a collapsible drying rod to distribute loads on an article held thereon.

As shown in FIG. 9, an exemplary collapsible drying rod 10 has a first 30, second 40, third 39 and fourth extensions 49. This exemplary elongated support 12 has five sections that enable a shorter collapsed drying rod length. In addition, the third 39 and fourth 49 extensions comprise bends 26, 26' respectively. These bends may be configured in the elongated support 12 to reduce stress or load on a garment hung thereon.

As shown in FIG. 10, an exemplary collapsible drying rod 10 has the hanger portion 60 detached from the center support member 20. Detaching the hanger portion may enable more compact storage of, the collapsible drying rod 10. In addition, the exemplary collapsible drying rod 10 has hanger clips 69, 69' attached to the elongated support 12. The clips are coupled to the elongated support by rings that enable the clips to freely slide along the length of the elongated support. Hanger clip 69' is shown in an open position, and hanger clip 69 is shown in a closed position. Any suitable type of clip may be attached to the collapsible drying rod including alligator clips, binder clips, locking clips, clips comprising a spring and the like.

As shown in FIG. 11, an exemplary collapsible drying rod 10 has a first extension 30 and second extension 40 pulled out from the center support member 20, or disengaged, and coupled to the center support member by, an elastic tether 50 that is retained within the first and second extensions. The first and second ends of the tether 52, 54, respectively, are configured within the conduit of the first and second extensions. Tether retainers 56, 66' are configured within the conduits of the first and second extensions and prevent the tether from moving. A tether retainer, such as a stop, may be slid into the conduit of the extension with the tether attached and tension of the tether may expand the stop and prevent the stop from sliding out or moving within the conduit. Any suitable type of tether retainer may be used to secure the end of the tether to an extension however, including adhesives, fasteners and the like.

As shown in FIG. 12, an exemplary collapsible drying rod 10 has a first extension 30 and second extension 40 pulled out from the center support member 20 and coupled to the center support member by an elastic tether 50 that is retained within the end portions 80, 80'.

As shown in FIG. 13, an exemplary end portion 80 extends over the outer surface 21 of the first extension 30 and has an aperture 82 through which the elastic tether 50 extends. A knot is configured in the first end 52 of the elastic tether to form a tether retainer 56 that prevents the end from passing through the aperture.

As shown in FIG. 14, an exemplary end portion 80 extends into the conduit 22 of the first extension 30 and has a plurality of apertures 82, 82' through which the elastic tether 50 extends. A tether retainer 56 is configured on the first end 52 of the elastic tether to prevent the end from passing through the aperture.

As shown in FIG. 15, an exemplary end portion 80 has an aperture 82 through which the elastic tether 50 extends. A tether retainer 56 is configured on the first end 52 of the elastic tether to prevent the end from passing through the aperture. In this embodiment, the tether retainer is not a knotted portion of the retainer, rather it is a separate component that the tether is attached to, such as a plug or washer and the like.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A collapsible drying rod comprising:

a. an elongated support portion comprising;

a first terminal end;

a second terminal end;

a center support member comprising:

a first end;

a second end;

a length between the first end and second end;

a center support member conduit that extends from said first and second ends along at least a portion of said length;

a first extension coupled to the first end of the center support member and comprising:

a first engagement end;

a first extended end;

a first extension;

a second extension coupled to the second end of the center support member and comprising:

a second engagement end;

a second extended end;

a second extension;

at least one elastic tether extending from the center support member conduit and between the center support member and the first and the second extensions;

wherein the at least one elastic tether is in an extended state and retains the first and second extensions in engagement with the center support member;

b. a hanger portion attached to the center support member for suspending the elongated support portion.

2. The collapsible drying rod of claim 1, wherein of the center support member conduit extends the entire length of the center support member from the first end to the second end, and wherein the at least one elastic tether extends through the center support member conduit and is attached to the first and second extensions.

3. The collapsible drying rod of claim 2, wherein the first and second extensions comprise a first extension conduit and a second extension conduit that extends from the first and second engagement ends along at least a portion of the first and second extensions, respectively; and wherein the at least one elastic tether extends from the center support member conduit into the first and second extension conduits.

4. The collapsible drying rod of claim 1, wherein the first and second extensions comprise a first extension conduit and a second extension conduit that extends from the first and second engagement ends along at least a portion of the first and second extensions, respectively; and wherein the at least one elastic tether extends from the center support member conduit into the first and second extension conduits.

5. The collapsible drying rod of claim 1, comprising a conduit that extends from the first terminal end to the second terminal end.

6. The collapsible drying rod of claim 1, wherein the first and second extensions comprise an end portion configured on the first and second extended ends respectively.

7. The collapsible drying rod of claim 6, wherein a first extension conduit and a second extension conduit extends from first and second engagement ends to the first and second extended ends, respectively, and wherein the at least one elastic tether is attached to the elongated support and hanger portions.

8. The collapsible drying rod of claim 1, wherein the first end and the second end of the center support member are truncated ends and wherein the first engagement end and the second engagement end are configured to fit over said truncated ends.

9. The collapsible drying rod of claim 1, wherein the first engagement end and the second engagement end are truncated ends configured to fit within the center support member conduit on the first end and the second end of the center support member.

10. The collapsible drying rod of claim 1, wherein the elongated support comprises a length axis and a bend on either side of the hanger portion, wherein the elongated support portion extends from said bend to the first and second terminal ends in an acute angle to the length axis.

11. The collapsible drying rod of claim 10, wherein the bend on either side of the hanger portion is in the center support member.

12. The collapsible drying rod of claim 10, wherein a first bend on a first side of the hanger portion is in the first extension and wherein a second bend, on a second and opposing side of the hanger portion to the first bend, is in the second extension.

13. The collapsible drying rod of claim 1, wherein the hanger portion is detachably attachable to the elongated support.

14. The collapsible drying rod of claim 1 wherein the hanger portion comprises:

a hanger retainer;

a flexible extension having an attached end and an extended end; and at least one clip coupled to the flexible extension.

15. The collapsible drying rod of claim 1, comprising a third and a fourth extension, wherein the third extension is coupled to the first extension and extends to the first terminal end, and wherein the fourth extension is coupled to the second extension and extends to the second terminal end.

16. The collapsible drying rod of claim 15, wherein the at least one elastic tether extends from the center support member to the third extension and wherein the at least one elastic tether extends from the center support member to the fourth extension.

17. The collapsible drying rod of claim 1, comprising a truncated end on at least one of the first or second ends of the center support member or the first or second engagement ends and wherein said truncated end comprises a press-ball.

18. The collapsible drying rod of claim 1, having a collapsed length that is less than one-half a length of the elongated support portion.

19. The collapsible drying rod of claim 1, comprising one or more hanger clips coupled to the elongated support portion.

20. A collapsible drying rod comprising:

a. an elongated support portion comprising:

a first terminal end;

a second terminal end;

a center support member comprising:

a first end;

a second end;

a length between the first end and second end, a center support member conduit that extends from said first end to said second ends;

a first extension coupled to the first end of the center support member and comprising;

a first engagement end;

a first extended end;

a first extension length;

a first extension conduit extending from said first engagement end at least a portion of said first extension length;

a second extension coupled to the second end of the center support member and comprising:

a second engagement end;

a second extended end;

a second extension length;

a second extension conduit extending from said second engagement end at least a portion of said second extension length;

a single elastic tether having a first tether end and a second tether end;

wherein the single elastic tether extends through the center support member conduit and into the first and second extension conduits;

wherein the first tether end is configured in the first extension conduit and the second tether end is configured in the second extension conduit;

wherein the single elastic tether is in an extended state and retains the first and second extensions in engagement with the center support member; and b. a hanger portion attached to the center support member for suspending the elongated support.

* * * * *